US008731440B2

(12) United States Patent
Makino et al.

(10) Patent No.: US 8,731,440 B2
(45) **Date of Patent: *May 20, 2014**

(54) CORONA CHARGER INCLUDING SHUTTER

(75) Inventors: Yuichi Makino, Abiko (JP); Hiroyuki Kidaka, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 538 days.

This patent is subject to a terminal disclaimer.

(21) Appl. No.: 12/640,105

(22) Filed: Dec. 17, 2009

(65) Prior Publication Data

US 2010/0158550 A1 Jun. 24, 2010

(30) Foreign Application Priority Data

Dec. 19, 2008 (JP) ..... 2008-324404

(51) Int. Cl.
*G03G 15/02* (2006.01)

(52) U.S. Cl.
USPC ..... 399/170

(58) Field of Classification Search
USPC ..... 399/168, 170–173; 361/213, 220, 222, 361/223, 225, 229; 250/324–326
See application file for complete search history.

(56) References Cited

U.S. PATENT DOCUMENTS

| | | | | |
|---|---|---|---|---|
| 5,504,560 | A * | 4/1996 | Kitagaki et al. | 399/168 |
| 6,934,507 | B2 | 8/2005 | Ohki et al. | |
| 7,139,522 | B2 | 11/2006 | Ohki et al. | |
| 7,599,642 | B2 | 10/2009 | Nakajima et al. | |
| 8,036,565 | B2 | 10/2011 | Nakajima et al. | |
| 2004/0131406 | A1 | 7/2004 | Ohki et al. | |
| 2005/0276642 | A1 | 12/2005 | Ohki et al. | |
| 2008/0038011 | A1 | 2/2008 | Nakajima et al. | |
| 2009/0136253 | A1 | 5/2009 | Nakajima et al. | |
| 2011/0286767 | A1 | 11/2011 | Nakajima et al. | |

FOREIGN PATENT DOCUMENTS

| | | | |
|---|---|---|---|
| JP | 61-99164 | A | 5/1986 |
| JP | 10-20624 | A | 1/1998 |
| JP | 2001-175058 | A | 6/2001 |
| JP | 2005-343176 | A | 12/2005 |
| JP | 2005-353521 | A | 12/2005 |
| JP | 2007-072212 | A | 3/2007 |
| JP | 2008-46297 | A | 2/2008 |
| KR | 2005-0118657 | A | 12/2005 |

OTHER PUBLICATIONS

Notice of Allowance dated Apr. 24, 2012, in Korean Application No. 10-2009-0126664.
Decision on Grant—Patent for Invention dated Apr. 27, 2011, in counterpart Russian Application No. 2009147229/28.
Notification of First Office Action dated Oct. 26, 2011, in Chinese Application No. 200910259422.X.
Search Report dated Mar. 16, 2010, in related European Application No. 09179677.1-2209.

* cited by examiner

*Primary Examiner* — Walter L Lindsay, Jr.
*Assistant Examiner* — Milton Gonzalez
(74) *Attorney, Agent, or Firm* — Fitzpatrick, Cella, Harper & Scinto

(57) ABSTRACT

A charging device includes a corona charger, provided with an opening opposing a photosensitive member, for electrically charging the photosensitive member; a sheet-like member provided so that the sheet-like member can cover the opening; a movable device for moving the sheet-like member; and a regulating device for regulating a shape of the sheet-like member so that a central portion of the sheet-like member protrudes toward the corona charger with respect to a circumferential direction of the photosensitive member.

26 Claims, 9 Drawing Sheets

CORONA CHARGER INCLUDING SHUTTER

FIELD OF THE INVENTION AND RELATED ART

The present invention relates to a corona charger used in an image forming apparatus, such as a copying machine, a printer, a facsimile machine, or a multi-function machine having a plurality of functions of these machines.

In an image forming apparatus of an electrophotographic type, an image has been conventionally formed through an electrophotographic process including steps of charging, exposure, development and transfer. Of these steps, in the charging step a photosensitive member has been electrically charged uniformly to a potential of a predetermined polarity by a corona charger provided closely to the photosensitive member. In the charging step using the corona charger, corona discharge is utilized, so that an electric discharge product such as ozone ($O_3$) or nitrogen oxides ($NO_x$) is generated. When such an electric discharge product is deposited on the photosensitive member and takes up moisture, a so-called "image deletion (flow)" phenomenon such that a surface resistance at a opening on which the electric discharge product is deposited is lowered, thus failing to faithfully reproduce an electrostatic latent image depending on image information.

Japanese Laid-Open Patent Application (JP-A) 2007-072212 discloses prevention of deposition of the electric discharge product on the photosensitive member during non-image formation by providing a shutter to the corona charger so as to cover an opening of the corona charger. Specifically, JP-A 2007-072212 proposes opening and closing movement of the shutter along a longitudinal direction of the charging shutter. According to a study by the present inventor, as shown in FIG. 13, in the case where a corona charger 200 is intended to be brought nearer to a photosensitive member 100 compared with a conventional image forming apparatus, the following findings have been obtained. Incidentally, a reference symbol 200*a* represents a grid electrode.

That is, in the case where the corona charger 200 is provided in proximity to the photosensitive member 100, the shutter is configured to move to be opened and closed between the corona charger 200 and the photosensitive member 100. Therefore, it has been found that the shutter as a sheet-like member may preferably be employed so as not to deteriorate the photosensitive member 100 even when the shutter can contact the photosensitive member 100.

However, a space, between the corona charger 200 and the photosensitive member 100, through which the shutter passes has a shape of curvature (FIG. 13) corresponding to a shape of an outer circumferential surface of the photosensitive member, so that there is a possibility that the shutter forms a sliding relation with the photosensitive member or the corona charger by the opening and closing movement thereof.

That is, in the case where the shutter has a linear and flat shape with respect to a short direction thereof as in JP-A 2007-072212, the shutter shape does not correspond to the shape of curvature of the space between the corona charger and the photosensitive member, with the result that the shutter forms the sliding relation with the photosensitive member or the corona charger (a shield or a grid electrode).

Thus, when the shutter forms the sliding relation with the corona charger, the shutter is caught by the corona charger, so that the opening and closing movement of the shutter cannot be properly effected.

Further, when the shutter forms the sliding relation with the photosensitive member every opening and closing movement thereof, deterioration of the photosensitive member cannot be disregarded.

SUMMARY OF THE INVENTION

A principal object of the present invention is to provide a charging device capable of properly effecting opening and closing movement of a sheet-like member even when a corona charger is provided in proximity to a photosensitive member.

According to an aspect of the present invention is to provide a charging device comprising:

a corona charger, provided with an opening opposing a photosensitive member, for electrically charging the photosensitive member;

a sheet-like member provided so that the sheet-like member can cover the opening;

movable means for moving the sheet-like member; and regulating means for regulating a shape of the sheet-like member so that a central portion of the sheet-like member protrudes toward or is convex toward the corona charger with respect to a circumferential direction of the photosensitive member.

Another object of the present invention is to provide a charging device capable of preventing deterioration of the photosensitive member by the opening and closing movement of the sheet-like member even when the corona charger is provided in proximity to the photosensitive member.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Figure 1:
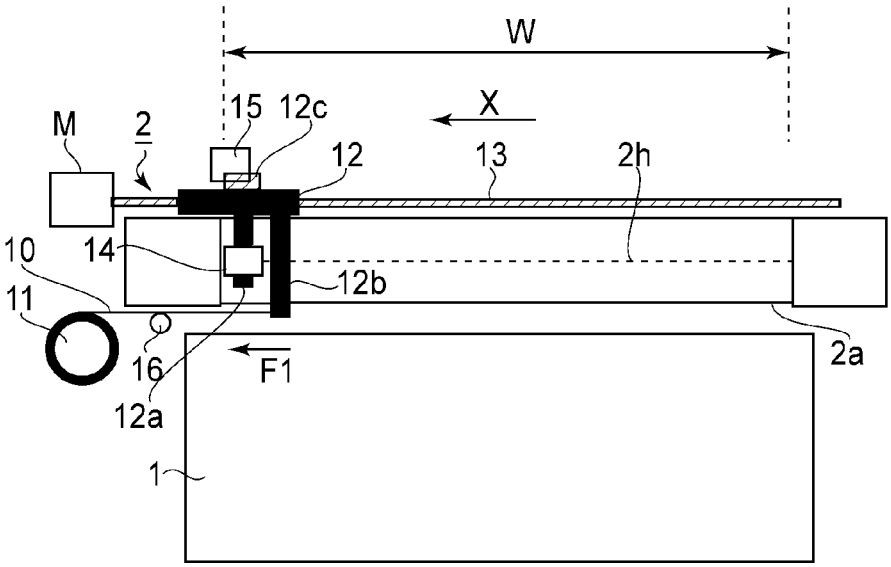
FIG. 1 is a schematic sectional view showing a state in which a charger shutter is opened.

Hereinbelow, embodiments according to the present invention will be described with reference to the drawings. Incidentally, in the respective drawings, members or means indicating by identical reference numerals or symbols have the same constitutions or functions, thus being appropriately omitted from redundant explanation.

[Embodiment 1]

First, a general structure of the image forming apparatus will be described with reference to FIG. 3. The image forming apparatus in this embodiment is a laser beam printer of an electrophotographic type.

(General Structure of Image Forming Apparatus)

Figure 3:
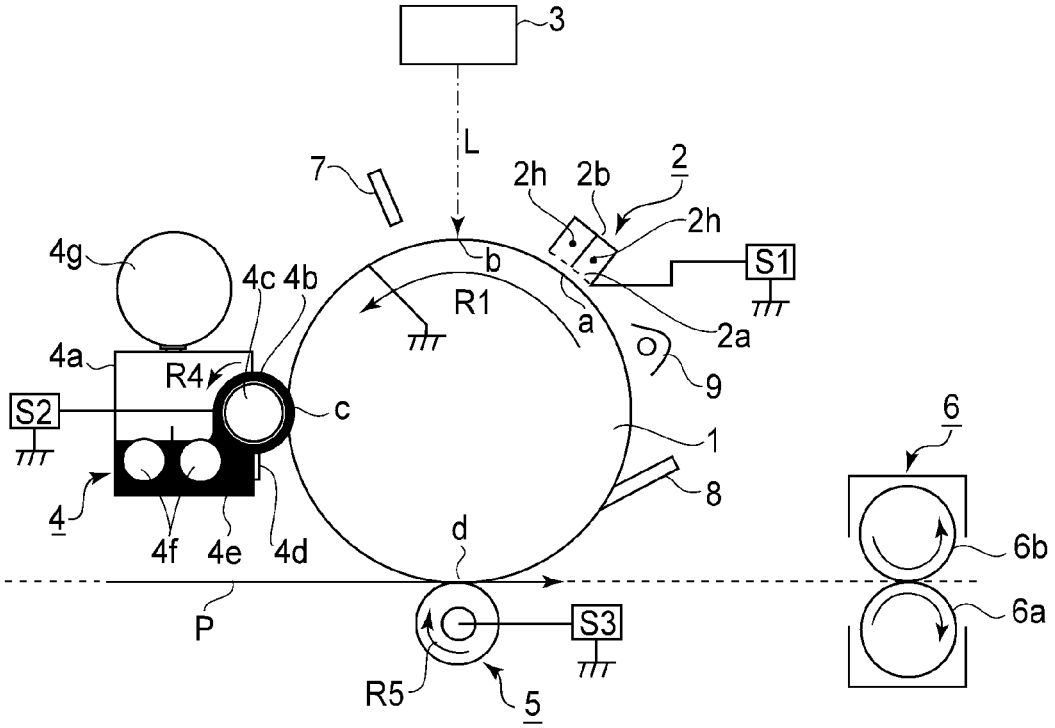
FIG. 3 is a schematic sectional view of an image forming apparatus.

As shown in FIG. 3, a charging device 2, an exposure device 3, a potential measuring device 7, a developing device 4, a transferring device 5, a cleaning device 8, and an optical discharging device 9 and disposed in this order around a photosensitive member (image bearing member) 1 along a rotational direction (indicated by an arrow R1) of the photosensitive member 1. Further, a fixing device 6 is disposed downstream of the transferring device 5 with respect to a conveying direction of a recording material P.

Next, individual image forming devices associated with image formation will be described specifically.

(Photosensitive Member)

The photosensitive member 1 in this embodiment as the image bearing member is a cylindrical (drum-type) electrophotographic photosensitive member as shown in FIG. 3. The photosensitive member 1 has a diameter of 84 mm and is rotationally driven in the arrow R1 direction about a center shaft (not shown) at a process speed (peripheral speed) of 500 mm/sec.

Figure 4:
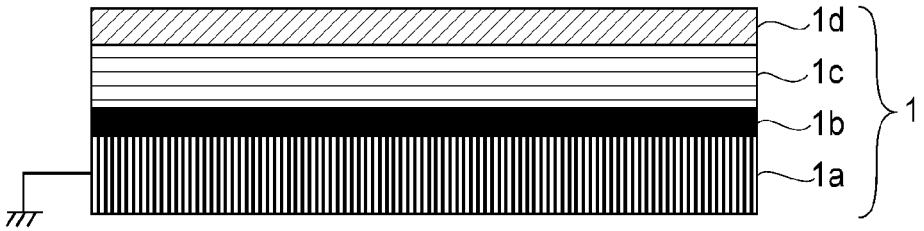
FIG. 4 is a schematic sectional view showing a layer structure of a photosensitive member.

Further, as shown in FIG. 4, the photosensitive member 1 includes a photosensitive layer of a negatively chargeable organic photoconductor. Specifically, the photosensitive member 1 includes an aluminum cylinder 1*a* as an electroconductive support at an inner position with respect to a radial direction (a lower portion in FIG. 4). On the cylinder 1*a*, a three-layer structure consisting of an under coat layer 1*b* for suppressing interference of light and improving an adhesiveness with an upper layer, a charge generation layer 1*c*, and a charge transport layer 1*d* is formed. The charge generation layer 1*c* and the charge transport layer 1*d* constitute the photosensitive layer described above.

(Charging Device)

Figure 5:
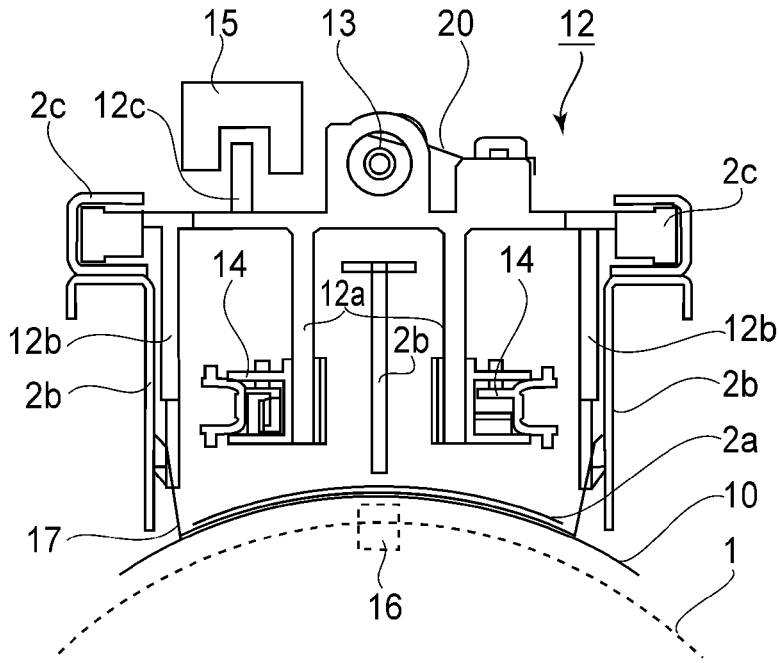
FIG. 5 is a schematic sectional view of a corona charger.

The charging device 2 in this embodiment is, as shown in FIG. 3, a corona charger of a scorotron type including a discharging wire 2*h*, a U-shaped electroconductive shield 2*b* which is provided so as to surround the discharging wire, and a grid electrode 2*a* provided at an opening of the shield 2*b*. In this embodiment, in order to meet high-speed image formation, the corona charger 2 includes two discharging wire 2*h* and a partition wall provided between the two discharging wires 2*h*. The corona charger 2 is provided along a generatrix direction of the photosensitive member 1. Therefore, a longitudinal direction of the corona charger 2 is parallel to an axial (shaft) direction of the photosensitive member 1. Further, as shown in FIG. 5, the grid electrode 2*a* is disposed along the circumferential surface of the photosensitive member so that a central portion thereof with respect to a widthwise (short) direction (a photosensitive member movement direction) is separated from the photosensitive member in a larger distance than that at both end portions thereof. Therefore, in this embodiment, compared with the conventional image forming apparatus, the corona charger 2 can be brought nearer to the photosensitive member 1, so that a charging efficiency can be improved.

Referring to FIG. 3, a charging bias application source S1 for applying a charging bias is connected to the corona charger 2, so that the corona charger 2 has the function of uniformly charging the surface of the photosensitive member 1 to a potential of a negative polarity at a charging position a by the charging bias applied from the application source S1. Specifically, a DC voltage is applied to the discharging wires 2*h* and the grid electrode 2*a*.

(Exposure Device)

The exposure device 3 in this embodiment is a laser beam scanner including a semiconductor laser for irradiating the photosensitive member 1 charged by the corona charger 2 with laser light L. Specifically, on the basis of an image signal (information) sent from a host computer connected to the image forming apparatus through a network cable, the image exposure device 3 outputs the laser light L. The charged surface of the photosensitive member 1 is exposed to the laser light L along a main scan direction at an exposure position b. By repeating the exposure along the main scan direction during the rotation of the photosensitive member 1, of the charged surface of the photosensitive member 1, a portion irradiated with the laser light L is lowered in potential, so that an electrostatic latent image is formed correspondingly to the image information.

Here, the main scan direction means a direction parallel to the generatrix of the photosensitive member 1 and a sub-scan direction means a direction parallel to the rotational direction of the photosensitive member 1.

(Developing Device)

The developing device 4 deposits a developer (toner) on the electrostatic latent image formed on the photosensitive member 1 by the charging device 2 and the exposure device 3 to visualize the latent image. The developing device in this embodiment employs a two component magnetic brush developing method and also employs a reverse developing method. The developing device 4 includes a developing container 4*a*, a developing sleeve 4*b*, a magnet 4*c*, a developing blade 4*d*, a developer stirring member 4*f*, and a toner hopper 4*g*. Incidentally, a reference symbol 4*e* shown in FIG. 3 represents a two component developer accommodated in the developing container 4*a*. The developing sleeve 4*b* is a non-magnetic cylindrical member and is rotatably provided to the developing container 4*a* while a part of an outer peripheral surface thereof is outwardly exposed. The magnet 4*c* is provided in the developing sleeve 4*b* in a state in which it is non-rotatable and fixed. The developing blade 4*d* regulates a thickness of the two component developer 4*e* coated on the developing sleeve surface. The developer stirring member 4*f* is disposed on a bottom side in the developing container 4*a* and feeds the two component developer 4*e* toward the developing sleeve 4*b* while stirring the developer. The toner hopper 4*g* is a container containing toner to be supplied to the developing container 4*a*. The two component developer 4*e* in the developing container 4*a* is a mixture of the toner and a magnetic carrier and is stirred by the developer stirring member 4*f*. The magnetic carrier has a resistance of about $10^{13}$ ohm.cm and a particle size of 40 μm. The toner is triboelectrically charged to a negative polarity by rubbing with the carrier. The above-described developing sleeve 4*b* is disposed oppositely to the photosensitive member 1 so as to provide the closest distance of 350 μm from the photosensitive member 1. A portion at which the photosensitive member 1 and the developing sleeve 4*b* oppose each other constitutes a developing portion c. The developing sleeve 4*b* is rotationally driven so that a movement direction of its surface is opposite from the movement direction of the photosensitive member 1 surface at the developing portion c. That is, the developing sleeve 4*b* is rotationally driven in a direction indicated by an arrow R4 with respect to the arrow R1 direction of the photosensitive member 1. A part of the two component developer 4*e* in the developing container 4*a* is held as a magnetic brush layer at the outer peripheral surface of the developing sleeve 4*b* by a magnetic force of the inner magnet 4*c* and is fed to the developing portion c by the rotation of the developing sleeve 4*b*. The magnetic brush layer is regulated as a predetermined thin layer by the developing blade 4*d*, so that the layer contacts the photosensitive member 1 at the developing portion c.

To the developing sleeve 4*b*, a developing bias application source S2 is connected, and the toner in the developer carried on the surface of the developing sleeve 4*b* is selectively deposited correspondingly to the electrostatic latent image on the photosensitive member 1 by an electric field generated by a developing bias applied from the application source S2. As a result, the electrostatic latent image is developed as the toner image. In this embodiment, the toner is deposited at an exposed portion (laser light irradiation portion) on the photosensitive member 1, so that the electrostatic latent image is reversely developed. At this time, a charge amount of the toner subjected to the development on the photosensitive member 1 is about −25 μC/g. The developer on the developing sleeve 4*b* having passed through the developing portion c is collected in the developing container 4*a* by subsequent rotation of the developing sleeve 4*b*.

Further, in order to keep the toner content of the two component developer 4*e* in the developing container 4*a* in a substantially constant range, an optical toner content sensor is provided in the developing container 4*a*. The toner in an amount corresponding to the toner content detected by the toner content sensor is supplied from the toner hopper 4*g* to the developing container 4*a*.

(Transfer Device)

The transfer device 5 in this embodiment includes a transfer roller 5 as shown in FIG. 3. The transfer roller 5 is urged against the surface of the photosensitive member 1 with a predetermined urging force to form a nip therebetween as a transfer portion d. To the transfer portion d, the recording material P (e.g., paper or a transparent film) is sent from a sheet-feeding cassette with predetermined control timing.

The recording material P sent to the transfer d is subjected to transfer of the toner image formed on the photosensitive member 1 while being nip-conveyed between the photosensitive member 1 and the transfer roller 5. At this time, to the transfer roller 5, a transfer bias (+2 KV in this embodiment) of an opposite polarity to the normal charge polarity (negative) of the toner is applied from a transfer bias application source S3.

(Fixing Device)

The fixing device 6 in this embodiment includes a fixing roller 6*a* and a pressing roller 6*b* as shown in FIG. 3. The recording material P on which the toner image is transferred by the transfer device 5 is conveyed to the fixing device in which the toner image is heated and pressed between the fixing roller 6*a* and the pressing roller 6*b* to be fixed on the recording material P. The recording material P subjected to the fixing is then discharged outside the image forming apparatus.

(Cleaning Device)

The cleaning device 8 in this embodiment includes, as shown in FIG. 3, the cleaning blade. After the toner image is transferred on the recording material P by the transfer device 5, untransferred toner remaining on the photosensitive member 1 surface is removed by the cleaning blade.

(Optical Discharging Device)

The optical discharging device 9 in this embodiment includes, as shown in FIG. 3, a discharging exposure lamp. Residual charges remaining on the surface of the photosensitive member 1 subjected to the cleaning by the cleaning device 8 are removed by light irradiation by the discharging exposure lamp.

A series of the image forming process described above is completed and the image forming apparatus prepares for a subsequent image forming process.

(Charger Shutter)

Then, a charger shutter 10 as a sheet-like member for covering and uncovering the opening of the corona charger 2 will be described. The opening of the corona charger 2 refers to the opening formed with respect to the shield and corresponds to a charging area (W in FIG. 1) of the corona charger 2. Therefore, the charging area W of the corona charger 2 substantially coincides with an area in which the photosensitive member 1 is electrically chargeable.

FIG. 1 shows a state in which the charger shutter 10 as the sheet-like member is opened by being wound up so as to move in X direction (an opening direction. FIG. 6(B) shows a state in which the charger shutter 10 as the sheet-like member is closed by being pulled so as to move in Y direction (a closing direction).

Figure 2:
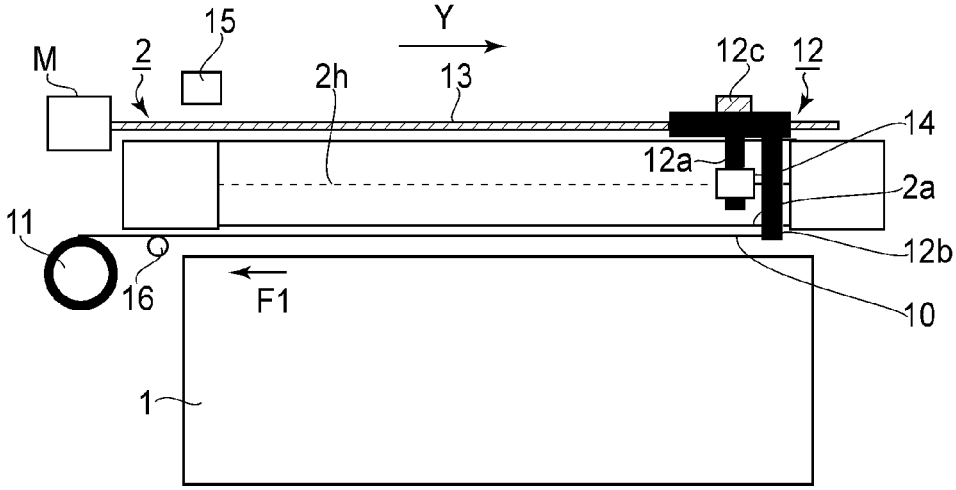
FIG. 2 is a schematic sectional view showing a state in which the charger shutter is closed.

In this embodiment, as shown in FIGS. 1 and 2, a non-endless sheet-like shutter capable of being wound up in a roll shape by a winding-up device 11 is employed as the charger shutter 10 for covering and uncovering the opening of the corona charger 2. This is attributable to the following reason in addition to prevention of passing of the corona discharge product falling from the corona charger 2 onto the photosensitive member 1. That is, the charging shutter 10 moves through a narrow gap (spacing) between the photosensitive member 1 and the grid electrode 2*a*, so that the sheet-like shutter capable of being wound up is employed for preventing the photosensitive member 1 from being damaged to cause image defect when the charger shutter 10 contacts the photosensitive member 1 by some possibility. Therefore, in this embodiment, as the charger shutter 10, a 30 μm-thick sheet-like member formed of polyimide resin is employed.

Further, the reason why a constitution in which the charger shutter 10 is retracted (wound up) in a roll shape on one end side with respect to a longitudinal direction (main scan direction) of the corona charger 2 during the image formation is employed is that a space during the retraction (opening) of the charging shutter 10 is reduced.

(Charger Shutter Opening and Closing Mechanism)

Figure 6:
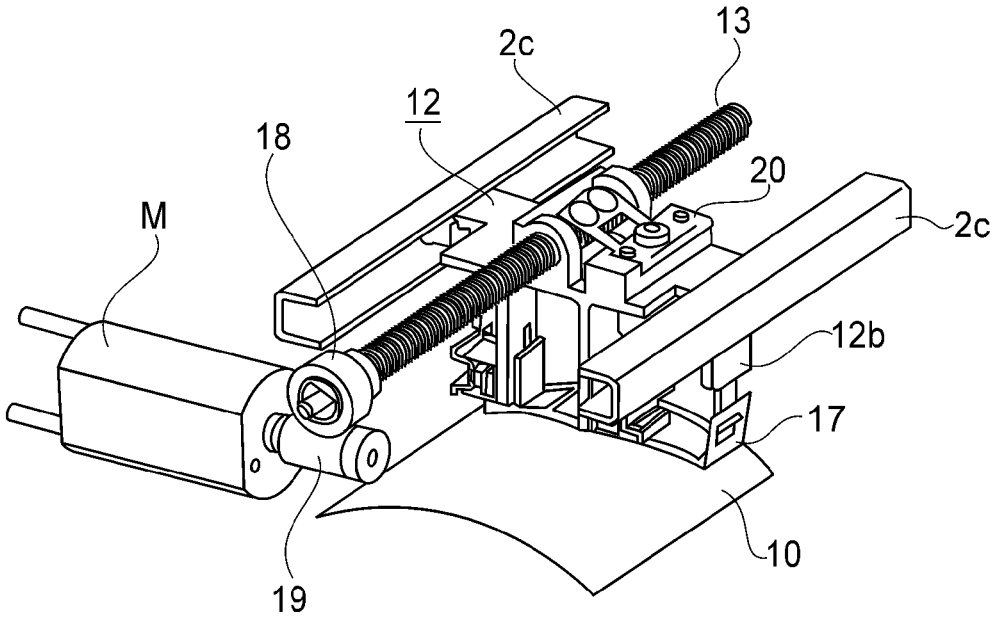
FIG. 6 is a schematic perspective view showing an opening and closing mechanism for the charger shutter.

An opening and closing mechanism (movable means) for the charger shutter 10 will be described. FIGS. 1 and 2 show open and closed states of the charger shutter 10, respectively. FIG. 5 is a schematic sectional view of the corona charger as seen from one longitudinal end side of the corona charger. FIG. 6 is a perspective view showing details of the opening and closing mechanism.

The opening and closing mechanism includes a driving motor M, a winding-up device 11, a movable member 12, a connecting member 12*a*, a connecting member 12*b*, and a rotatable member 13 and performs the function of moving the charger shutter 10 along the longitudinal direction (the main scan direction) of the charger shutter 10 so as to be opened and closed.

In this embodiment, a shutter detecting device 15 for detecting completion of an opening operation of the charger shutter 10 is provided. The shutter detecting device 15 includes a photo-interrupter. When the movable member 12 reaches the opening operation completion position, the opening operation completion of the charger shutter 10 is detected by utilizing light-blocking of the photo-interrupter 15 by a light-blocking member 12*c*. That is, at the time when the shutter detecting device 15 detects the light-blocking member 12*c*, the rotation of the motor M is stopped.

As shown in FIGS. 5 and 6, on a leading end side of the charging shutter 10 with respect to a closing direction of the charging shutter 10, a shutter fixing member 17 functioning as a regulating means for regulating the shape of the charging shutter is provided so that a short direction central portion of the charging shutter protrudes toward the corona charger. The shutter fixing member is locked and fixed to the connecting member 12*b* provided integrally with the movable member 12. The movable member 12 includes a drive transmission member 20 provided threadably mounted on the rotatable member 13 and is driving-connected with the rotatable member 13 through the drive transmission member 20. Further, the movable member 12 is threadably mounted so as to be movable only in the main scan direction on a rail 2*c* provided on the shield 2*b*, thus being prevented from rotating together with the rotatable member 13.

To the rotatable member 13, a spiral groove is provided as shown in FIG. 6 and a gear 18 is connected at one end of the rotatable member 13. On the other hand, to an end of the motor M, a warm gear 19 is connected and transmits a driving force of the driving motor M to the rotatable member 13 through an engaging portion between the warm gear 19 and the gear 18.

When the rotatable member 13 is rotationally driven by the driving motor M, the movable member 12 is moved in the main scan direction (X or Y direction) along the spiral groove. Therefore, when the rotatable member 13 is driven by the driving motor M, through the connecting member 12*b* formed integrally with the movable member 12, a moving force toward the opening and closing direction is transmitted to the charger shutter 10.

Further, the movable member 12 is integrally provided with the connecting member 12*a* for holding a cleaning member 14 for cleaning the discharging wire 2*h*, in addition to the connecting member 12*b* for engaging with the charging shutter 10.

Therefore, simultaneously, with the movement of the charging shutter 10 in the main scan direction (X or Y direction) by the driving motor M as described above, the cleaning member 14 is also moved in the same direction.

As a result, it becomes possible to drive the discharging wire 2*h* and the charging shutter 10 by the same driving motor M.

(Charger Shutter Winding-Up Mechanism)

Figure 7:
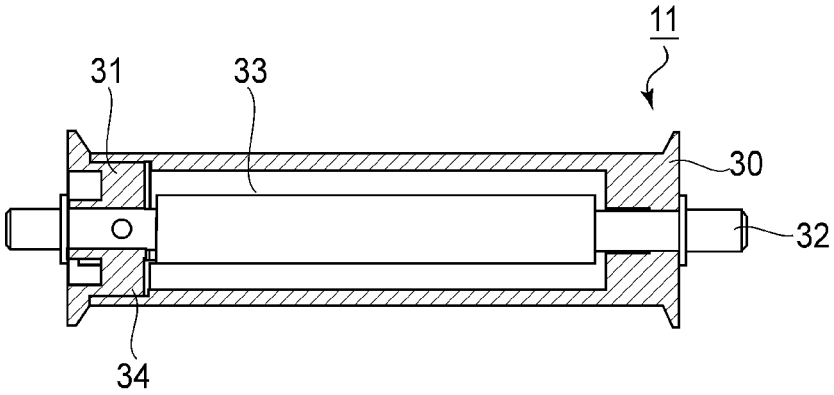
FIG. 7 is a schematic sectional view of a winding-up device.
Figure 8:
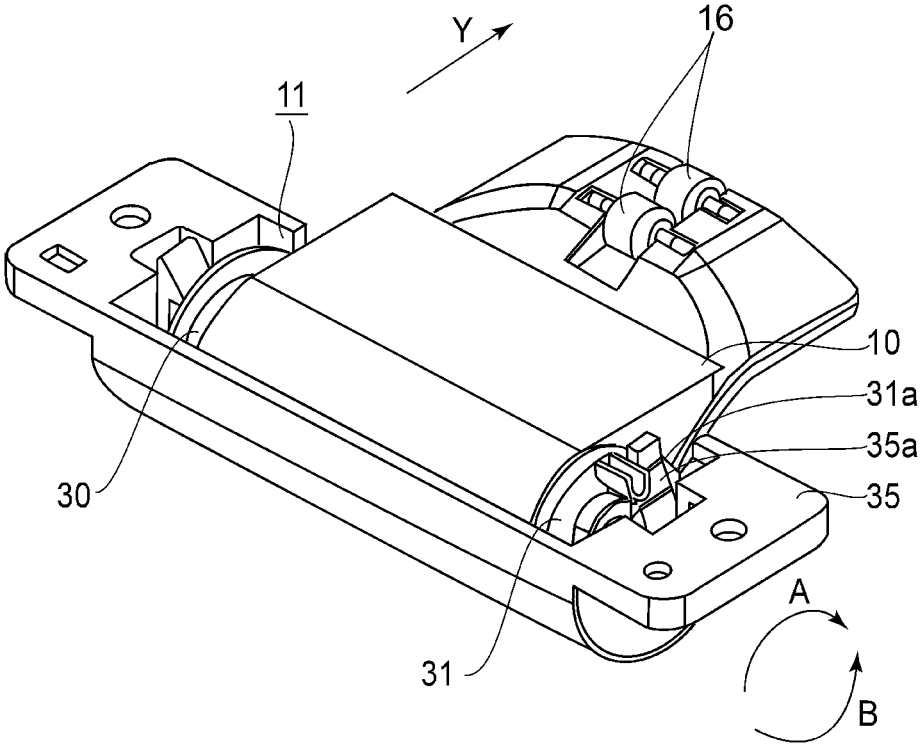
FIG. 8 is a schematic perspective view showing a state in which the winding-up device is set in a guide fixing member.

Next, the winding up mechanism of the charging shutter 10 will be described, FIG. 7 is a schematic view showing a constitution of the winding up device 11 as the winding up means, and FIG. 8 is a schematic view showing a state in which the winding up device 11 is mounted in a guide fixing member 35 for being attached to the corona charger 2.

The winding-up device 11 includes a cylindrical winding-up roller (winding-up member) 30 for fixing one end of the charging shutter 10 and for winding up the charging shutter 10, a shaft member 32 for shaft-supporting one end of the winding-up roller 30, and a shaft-supporting the other end of the winding-up roller 30. Further, the winding-up device 11 includes a parallel pin 34 which is a fixing member for fixing the shaft-supporting member 31 and the shaft member 32 and includes a spring (urging member) 33 provided in the winding-up roller 30 and engaged with the winding-up roller 30 and the shaft-supporting member 31.

Further, the winding up device 11 is configured so that a projection 31*a*of the shaft supporting member 31 is abutted against a projection 35*a* of the guide fixing member 35 by being mounted in the guide fixing member 35 as shown in FIG. 8. As a result, the shaft supporting member 31 and the shaft member 32 are fixed in a non rotatable manner, so that only the winding up roller 30 is shaft supported in a rotatable manner.

For the mounting, before the winding-up device 11 is mounted in the guide fixing member 35, the shaft-supporting member 31 is mounted in a state in which it is turned several times in a direction indicated by an arrow B while the winding-up roller 30 is fixed, in order to exert a rotational force in a direction indicated by an arrow A on the shaft-supporting member 31.

As a result, when the charging shutter 10 is pulled in its opening direction (Y direction), torsional stress of the spring 33 is exerted in a direction in which the winding-up roller 30 winds up the charging shutter 10 and the shaft-supporting member 31 receives the force exerted in the A direction, so that the shaft-supporting member is abutted against the guide fixing member 35 to be fixed in the non-rotatable manner.

In this case, in order to prevent slack of the charging shutter 10, the following constitution is employed. That is, such a constitution that a winding up force is exerted so that a speed V1 of the movable member 12 moved in the X direction by the motor M and a speed V2 of the charging shutter 10 moved in the X direction by the winding up device 11 always satisfy a relationship of: V2>V1 is employed. For that reason, in this embodiment, an urging force of the winding up device 11 is weakest when the charging shutter 10 is moved to the opening operation completion position (FIG. 1) and therefore a speed at which the charging shutter 10 is pulled with an urging force F1 at this position is configured to be set at V2. That is, before the winding up device 11 is mounted in the guide fixing member 35, the number of turns of the shaft supporting member 31 in the B direction is adjusted and determined.

Therefore, when the charger shutter 10 is opened, in interrelation with the movement of the charger shutter 10 in the X direction by the motor M, the winding-up roller 30 winds up the charger shutter 10 at any time with no downward slack of the charger shutter 10.

On the other hand, when the charger shutter 10 is closed (FIG. 2), the driving motor M pulls the charger shutter 10 from the winding-up roller 30 against the urging force of the spring 33 in the winding-up roller 30, so that the charger shutter 10 is moved in the Y direction.

Incidentally, when the charger shutter 10 is in a completely closed state, by the urging force toward the X direction by the spring 33 in the winding-up roller 30 is exerted on the charger shutter 10, so that the charging shutter 10 does not slack down toward the photosensitive member.

Therefore, when the charging shutter 10 is closed, a constitution in which the gap is not readily created between the charging shutter 10 and the corona charger 2 is employed, so that it becomes possible to keep a state in which the corona product is less liable to be leaked to the outside.

(Curvature Shape Imparting Mechanism for Charging Shutter)

In this embodiment, the corona charger 2 is, as described above, disposed so that the central portion of the grid electrode 2*a* with respect to the short direction of the grid electrode 2*a* (the circumferential direction of the photosensitive member) is separated from the photosensitive member 1 along the circumferential surface of the photosensitive member 1 in a distance longer than that at the both end portions of the grid electrode 2*a*. For this purpose, in this embodiment, a curvature shape imparting mechanism as the regulating means is provided so that the shape of the charging shutter 10 also follow (corresponds to) the shape of curvature of the circumferential surface of the photosensitive member 1. In this embodiment, as the curvature shape imparting mechanism, the curvature shape imparting mechanism for the leading end of the charging shutter 10 and the curvature shape imparting mechanism for the charging shutter 10 on the winding-up port side are provided and will be described below in this order.

(Curvature Shape Imparting Mechanism for Leading End of Charging Shutter 10)

Figure 9:
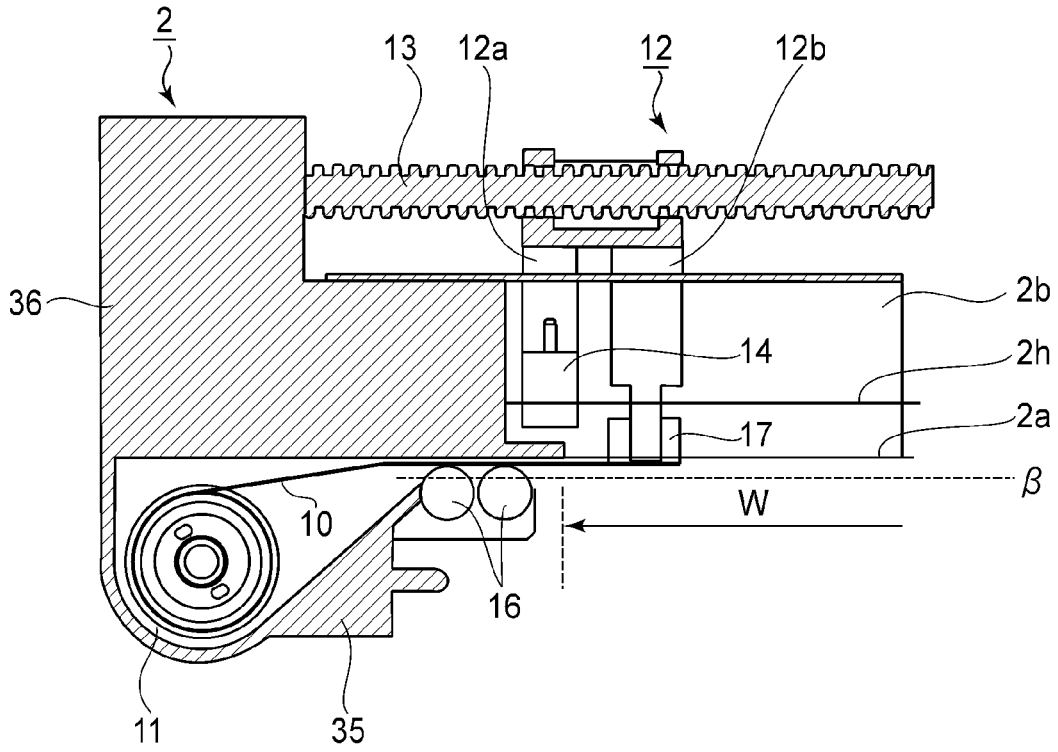
FIG. 9 is a schematic sectional view showing an opening and closing mechanism for the corona charger.

First, the curvature shape imparting mechanism for the leading end of the charging shutter 10 will be described. FIG. 9 is a sectional view of the corona charger as seen from its short direction (the left-right direction in FIG. 5) side, FIG. 10(A) shows a state before the shutter fixing member 17 as the regulating member is attached to the connecting member 12*b*, and FIG. 10(B) shows a state after the shutter fixing member 17 is attached to the connecting member 12*b*.

As shown in FIG. 9, on one longitudinal end side of the charging shutter 10 located out of a winding-up range of the winding-up device 11, the shutter fixing member 17 for fixing the charging shutter 10 to the movable member 12 is attached.

This shutter fixing member 17 is constituted by a member having elasticity so as to follow the shape of curvature of the circumferential surface of the photosensitive member 1 when the shutter fixing member 17 is attached to the connecting member 12*b*.

Figure 10:
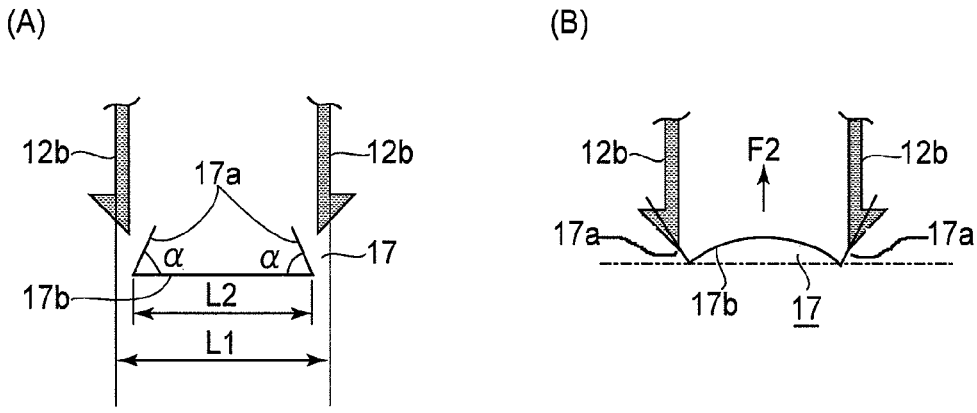
FIG. 10(A) is a schematic view showing a state before a shutter fixing member is attached.
FIG. 10(B) is a schematic view showing a state after the shutter fixing member is attached.

Specifically, as shown in FIG. 10(A), the shutter fixing member 17 is circumferential by a thin plate having resiliency and is configured to have a width L2 (before elastic deformation) set to be smaller than a width L1 of the connecting member 12*b*. Further, a mounting portion 17*a* of the shutter fixing member 17 to be mounted to the connecting member 12*a* is set to form an angle $\alpha$ of 90 degrees or less (45 degrees in this embodiment) between the mounting portion 17*a* and a mounting surface 17*b* for fixing the back surface of the charging shutter 10 (the surface of the charging shutter 10 facing the corona charger).

As a result, when the shutter fixing member 17 is attached to the connecting member 12*b*, as shown in FIG. 10(B), the shutter fixing member 17 is elastically deformed to receive a force F2 exerted in a direction in which the shutter fixing member 17 is moved apart from the photosensitive member 1. For that reason, the short direction central portion of the shutter mounting surface 17*b* has the shape of curvature protruding toward the corona charger, so that it is possible to impart the shape of curvature to the leading end of the charging shutter 10.

Incidentally, in this embodiment, as the shutter fixing member 17, the thin metal plate having resiliency is described as an example but a film material having elasticity may also be used. Further, it is also possible to use the thin metal plate having a predetermined shape of curvature in advance.

(Curvature Shape Imparting Mechanism for Charging Shutter 10 on Winding-Up Port Side)

In this embodiment, as shown in FIG. 9, a rotatable member, i.e., a so-called roller which is guiding member 16 is provided, as a second curvature shape imparting mechanism, for the charging shutter 10 on the winding-up port side of the winding-up device 11.

The guiding member 16 is different from the shutter fixing member 17 and is rotatably supported by the guide fixing member 35 fixed to a charging block 36 of the corona charger 2, thus having the function of guiding the charging shutter 10 so as to permit the opening and closing movement of the charging shutter 10. That is, the guiding member 16 has a structure such that it is rotated by the opening and closing movement of the charging shutter 10. Therefore, the guiding member 16 which is the roller can prevent an increase in load required for the opening and closing movement of the charging shutter 10 when the guiding member 16 regulates the shape of the charging shutter 10 so as to be a desired shape of curvature.

Further, the guiding member 16 is disposed at a position which is out of a winding-up range of the winding-up device 11 and is closer to the winding-up device 11 than the photosensitive member 1. In other words, the guiding member 16 is provided at a position downstream of the opening of the corona charger (the opening to which the grid electrode is attached), i.e., the charging area W of the corona charger, with respect to the opening direction of the charging shutter.

Therefore, the guiding member 16 guides the charging shutter so that the charging shutter 10 protrudes toward the corona charger at its short direction central portion.

Further, an uppermost portion of the roller as the guiding member 16 is located closer to the corona charger than the closest position (the outer circumferential surface) of the photosensitive member with respect to the corona charger 2, so that the charging shutter 10 always forms a sliding relation with the guiding member 16.

In this case, in order to ensure positional accuracy of the guiding member 16 with respect to the photosensitive member 1 or the corona charger 2, the guide fixing member 35 is provided with a positioning projection which is configured to position the photosensitive member 1, the corona charger 2, and the guide fixing member 35 to the same member.

Further, the guide fixing member 35 is fixed to the corona charger 2 and therefore is configured to have a structure such that the position projection and a portion constituting the guiding member 16 are elastically deformable, so that the guide fixing member 35 can always maintain the positional relationship with the photosensitive member 1.

Further, as shown in FIG. 5, the guiding member 16 is disposed only at the short direction central portion of the corona charger 2 and is, similarly as in the shutter fixing member 17, configured to impart the shape of curvature to the charging shutter 10.

In addition, the guiding member 16 also has, as shown in FIG. 9, the function as a shutter insertion guide for guiding the charging shutter 10 to the small gap (spacing) between the grid electrode 2*a* and the photosensitive member 1.

Therefore, also on the side where the charging shutter 11 is wound up by the winding-up device 11, it is possible to keep such a shape that the short direction central portion of the charging shutter 10 protrudes toward the corona charger 2. By imparting such a shape to the charging shutter 10, the gap between the corona charger 2 (the grid electrode 2*a*) and the photosensitive member 1 can be decreased as small as possible.

Incidentally, the shape of curvature of the charging shutter 10 is not necessarily required to coincide with the shape of curvature of the circumferential surface of the photosensitive member 1 within a range not hindering the opening and closing operation of the charging shutter 10.

Figure 14:
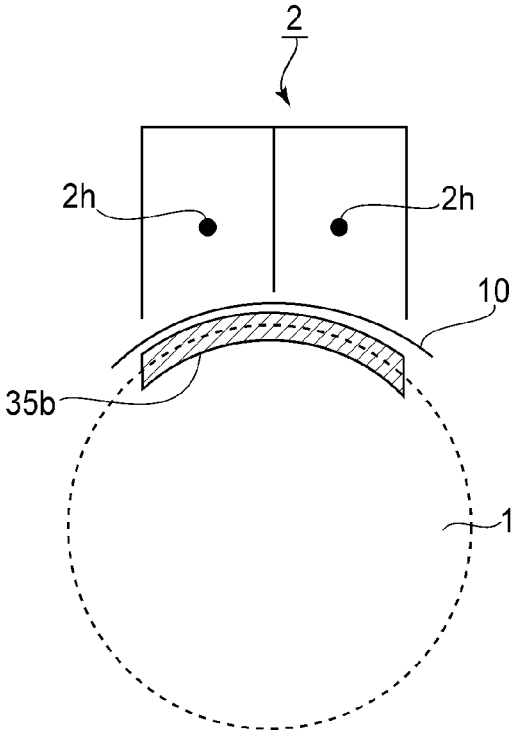
FIG. 14 is a schematic sectional view showing a guiding member having a shape of curvature.
Figure 15:
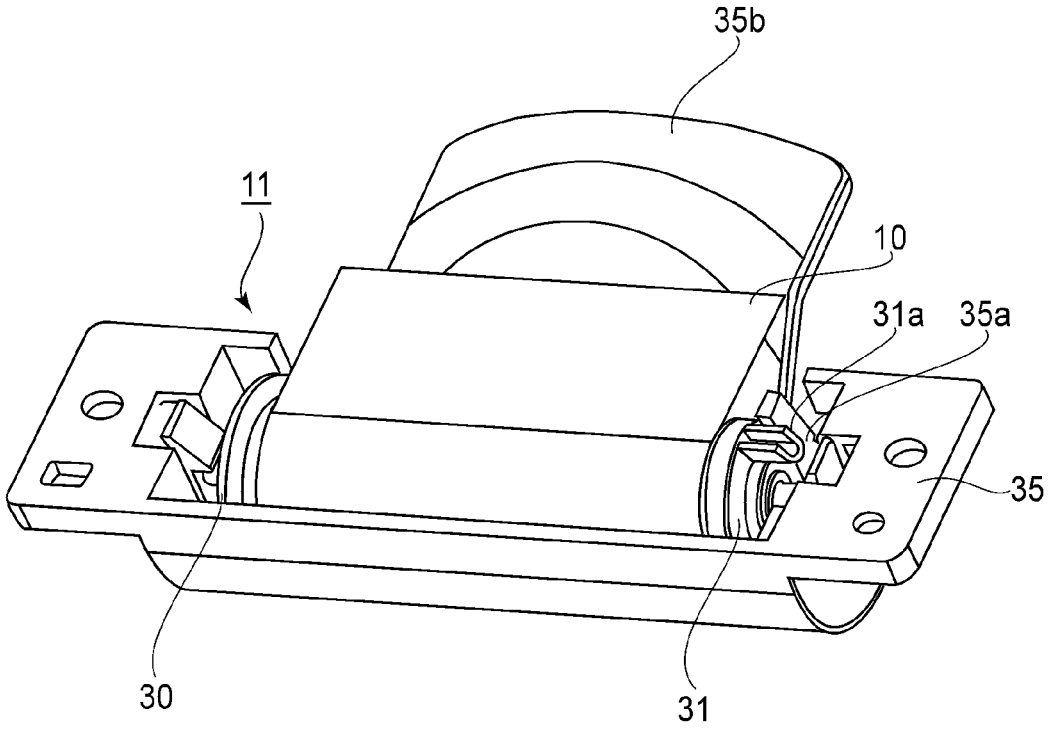
FIG. 15 is a schematic perspective view showing the guiding member having the shape of curvature.

In the above description, the roller used as the guiding member 16 is explained as an example but it is also possible to employ a constitution as shown in FIGS. 14 and 15. FIG. 14 is a sectional view of the corona charger and the photosensitive member as seen from their longitudinal direction, and FIG. 15 is a perspective view showing the guide fixing member 35 and the winding-up device 11. In FIGS. 14 and 15, members performing the same functions are represented by identical reference numerals or symbols, thus being omitted from detailed description.

As shown in FIGS. 14 and 15, a guide 35*b* having the shape of curvature which is provided to the guide fixing member 35 is, similarly as in the case of the roller, disposed at the position which is out of the winding-up range of the winding-up device 11 and is closer to the winding-up device 11 than the photosensitive member 1. Further, the guide 35*b* is located closer to the corona charger than the closest position (the outer circumferential surface) of the photosensitive member with respect to the corona charger 2, so that the charging shutter 10 always forms a sliding relation with the guide 35*b* having the shape of curvature.

Further, with respect to the ensuring of positional accuracy of the guide 35*b*, similarly as in the case of the roller, a positioning projection provided to the guide 35*b* is positioned to the same member together with the photosensitive member 1 and the corona charger 2.

Further, the guide fixing member 35 is fixed to the corona charger 2 and therefore is configured to have a structure such that the position projection and a portion constituting the guide 35*b* are elastically deformable, so that the guide fixing member 35 can always maintain the positional relationship with the photosensitive member 1.

Further, in this embodiment, the entire portion constituting the uppermost portion of the guide 35*b* is closer to the corona charger 2 than the closest position β of the photosensitive member 1 with respect to the corona charger 2 but, e.g., only the short direction central portion of the guide 35*b* may also protrude toward the corona charger 2.

Further, in the above description, as the curvature shape imparting mechanism, the two mechanisms consisting of the shutter fixing member 17 and the guiding member 16 (or the guide 35*b*) are used but it is also possible to provide at least the curvature shape imparting mechanism consisting of the shutter fixing member 17. However, in order to prevent the charging shutter 10 from contacting the photosensitive member 1 or the corona charger 2, it is preferable that the two mechanisms as described above are used in combination.

Figure 16:
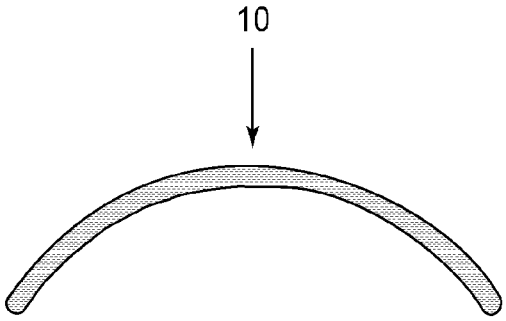
FIG. 16 is a schematic sectional view showing a charging shutter which has been subjected to a curvature shape imparting process (treatment) in advance.

Further, in order to prevent the charging shutter 10 from contacting the photosensitive member 1 or the corona charger 2 at a high level, it is also possible to employ a constitution in which the charging shutter 10 itself has been subjected to a shape processing treatment (curing treatment) in advance, thus having the same shape of curvature as that of the above-described charging shutter 10. Specifically, the shape of curvature of the charging shutter 10 after the shape processing treatment is that as shown in FIG. 16. FIG. 16 is a sectional view of the charging shutter 10 as seen from its longitudinal direction and such a positional relationship that the corona charger 2 is located over the charging shutter 10 and the photosensitive member 1 is located below the charging shutter 10 is satisfied.

In this embodiment, as the shape processing treatment, a heat treatment processing method was employed. First, a flat charging shutter 10 before the heat treatment is brought into intimate contact with a hollow metal roller having a diameter equal to that (84 mm in this embodiment) of the photosensitive member 1 and is fixed to the metal roller. Then, the metal roller to which the charging shutter 10 is fixed is left standing for about 10 minutes in a state in which the metal roller is heated from the inside thereof by a heating source so as to be kept at a predetermined temperature (150° C. in this embodiment). As a result, the shape of curvature is imparted to the charging shutter 10 so as to substantially follow the shape of curvature of the circumferential surface of the photosensitive member. Incidentally, with respect to the curvature shape imparting treatment (processing), in place of the above-described heat treatment processing method, it is also possible to employ other treatment methods. In this case, it is possible to achieve a sufficient effect by just imparting the shape of curvature to the charging shutter 10 by using the above-described shutter fixing member 17.

(Opening and Closing Control of Charging Shutter)

Figure 11:
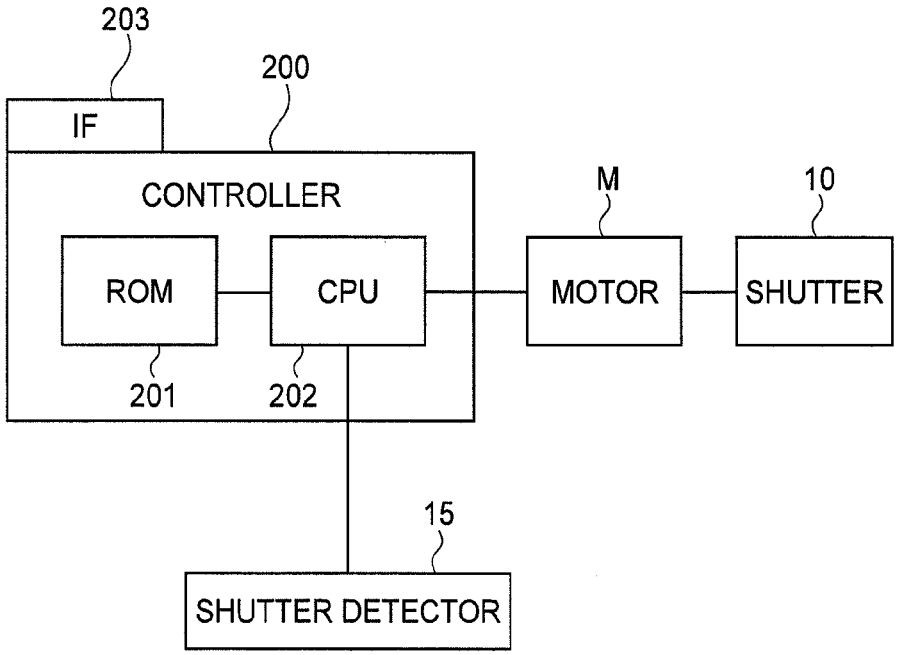
FIG. 11 is a block diagram for illustrating opening and closing control of the charging shutter.

Next, the opening and closing control of the charging shutter 10 will be described. FIG. 11 shows a block diagram for illustrating the opening and closing control of the charging shutter 10, and FIG. 12 shows control flow of the control.

As shown in FIG. 11, a controller portion 200 for controlling the opening and closing of the charging shutter 10 includes an ROM 201 in which a control program for realizing the opening and closing control of the charging shutter 10 is stored, and includes a CPU 202 for executing the opening and closing control in accordance with this control program. Further, the controller portion 200 is provided with an interface (input means) 203 through which information is input from a host computer via a network cable. The interface performs the function of obtaining the information from the host computer and sends the information to the CPU 202.

The CPU 202 executes the opening and closing of the charging shutter 10 by turning on and off the driving motor M connected to the charging shutter 10 through the movable member 12 and the like.

Figure 12:
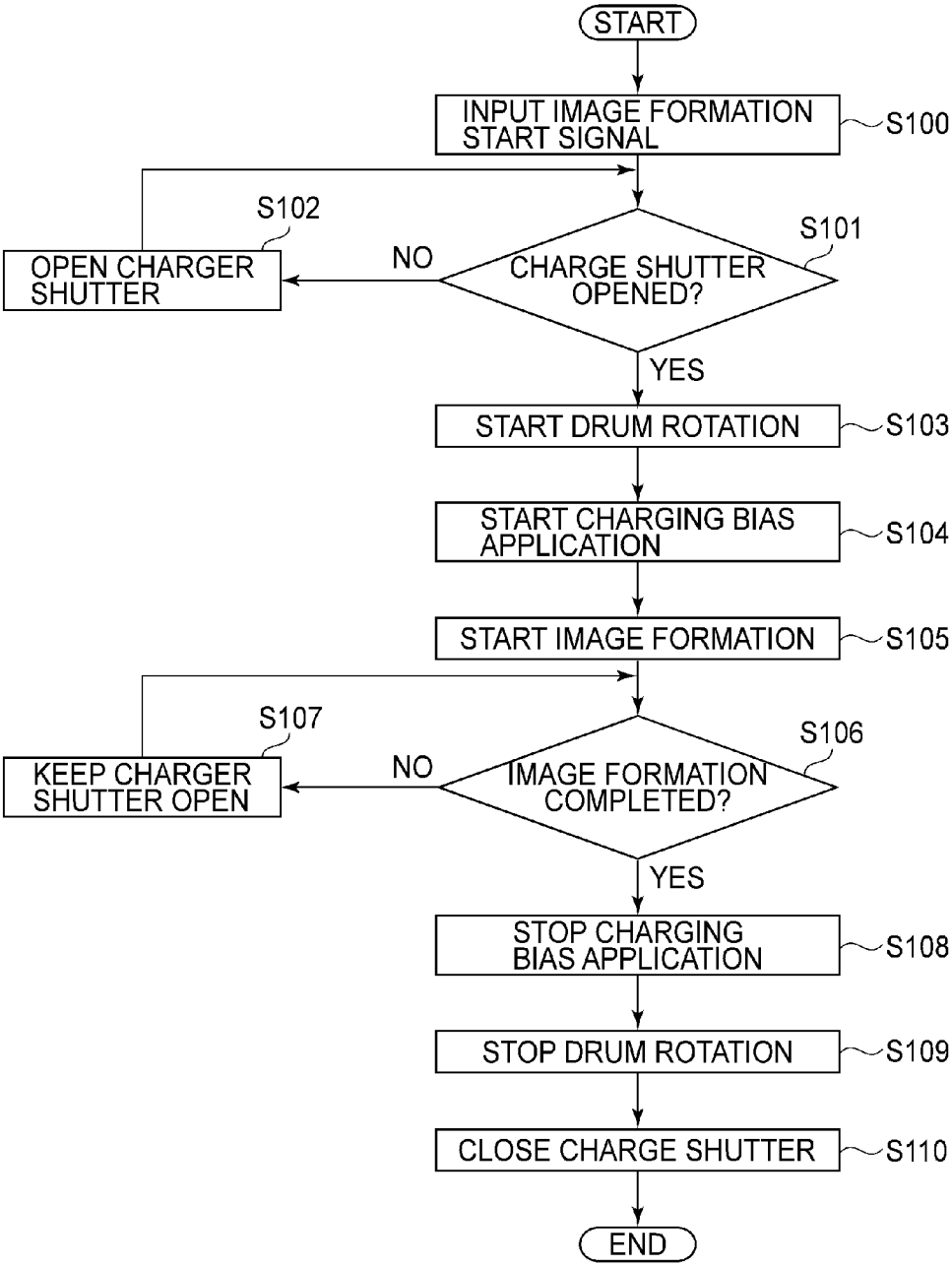
FIG. 12 is a flow chart for illustrating the opening and closing control of the charging shutter.
Figure 13:
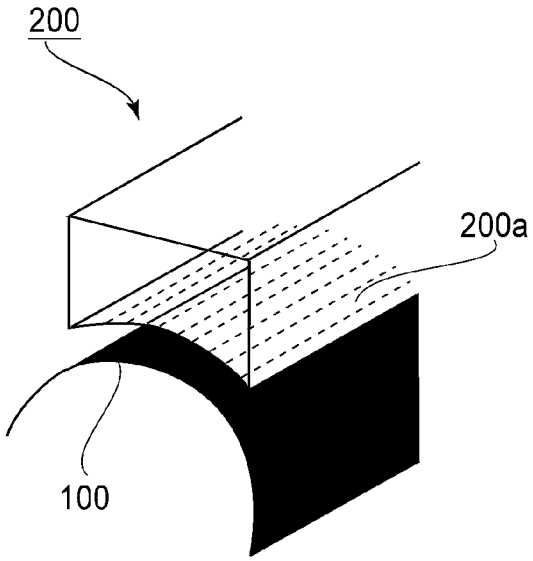
FIG. 13 is a schematic perspective view showing a positional relationship between the photosensitive member and the corona charger.

With reference to FIG. 12, the control flow during the execution of an image forming job, i.e., from input of an image formation start signal together with an image signal indicating information of an image to be output until a series of image forming processing is completed will be described. This control flow is processed and executed by the CPU 202. Incidentally, the above-described image signal and image formation start signal (image formation instruction signal) are input into the CPU 202 through the interface 203.

First, when the image formation start signal is input from the host computer (S100), whether or not the charging shutter 10 is located at the open position is judged on the basis of an output of the shutter detecting device 15 (S101).

In the case where the charging shutter 10 is not opened and is located at the closed position, the opening operation of the charging shutter 10 is executed (S102), and the processing is returned to the step S101. In the step S101, when the location of the charging shutter 10 at the open position is detected, a rotating operation of the photosensitive member 1 is started (S103). Then, after the start of the rotating operation of the photosensitive member 1, a charging bias is applied to the corona charger 2 (S104).

Then, upon completing preparatory operation of other image forming devices, image formation is started (S105).

Then, when the series of image formation is completed (S106), the charging bias application to the corona charger 2 is stopped (S108) and the rotation of the photosensitive member 1 is stopped (S109). Further, in the step S106, in the case where the image formation (image forming job) is judged as being not completed, the charging shutter 10 is controlled so as to be kept in the open state (S107).

Incidentally, in the case where an execution reservation of a subsequent image forming job is input, in the step S106, the judgment of "image formation completion" is not made and the subsequent image forming job is continued while the charging shutter 10 is kept in the open state (S107). That is, in the step S106, the judgment of "image formation completion" is made in the case where the execution reservation of the subsequent image forming job is not input from the start to completion of the current image forming job. Correspondingly to the stop of the rotation of the photosensitive member 1 (S109), the driving motor M is driven to rotate the rotatable member 13 in a direction opposite to the rotational direction of the rotatable member 13 during the opening operation, so that a closing operation of the charging shutter 10 is performed (S110) and the opening of the corona charger 2 is blocked (sealed).

As described above, by imparting the shape of curvature to the charging shutter 10, it is possible to smoothly and stably perform the opening and closing operation of the charging shutter 10. Further, it is also possible to prevent the photosensitive member 1 from being deteriorated by the charging shutter 10. Even when the corona charger 2 is provided in proximity to the photosensitive member 1, it is possible to prevent the photosensitive member 1 from being deteriorated by the opening and closing movement of the sheet-like member.

Therefore, the occurrence of improper charging due to the electric discharge product which is generated by the corona charger 2 and is transferred onto the photosensitive member 1 can be prevented. As a result, a degree of the occurrence of image defect such as image density non-uniformity or strips in the image can be alleviated.

Incidentally, in the above-described embodiments, the case where the corona charger 2 is used for substantially uniformly charging the photosensitive member 1 in a pre-step for forming the electrostatic image on the photosensitive member is described but the present invention is not limited thereto. For example, the present invention is similarly applicable to the case where the corona charger 2 is used for electrically charging the toner image formed on the photosensitive member 1.

Further, in the above-described embodiments, the case where the grid electrode is provided at the opening of the corona charger 2 is described but the present invention is similarly applicable to also the case where the grid electrode is not provided to the corona charger 2.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 324404/2008 filed Dec. 19, 2008, which is hereby incorporated by reference.

What is claimed is:

1. A charging device comprising:

a corona charger including a discharging wire configured to electrically charge a photosensitive member and a shield forming an opening opposed to said photosensitive member;

a sheet-like member configured to open and close the opening;

a moving mechanism configured to move said sheet-like member substantially along an axial direction of the photosensitive member; and a regulating mechanism configured to regulate a shape of said sheet-like member so that a central portion of said sheet-like member protrudes toward said discharging wire more than end portions, in a rotational direction of the photosensitive member, of said sheet-like member.

2. The charging device according to claim 1, wherein said regulating mechanism includes a regulating member fixed to said sheet-like member and configured to regulate the shape of said sheet-like member so that the central portion of said sheet-like member protrudes toward said discharging wire more than the end portions of said sheet-like member.

3. The charging device according to claim 2, wherein said regulating member is fixed to a leading end portion of said sheet-like member with respect to a closing movement direction of said sheet-like member.

4. The charging device according to claim 1, wherein said regulating mechanism includes a guiding member configured to guide said sheet-like member so that the central portion of said sheet-like member protrudes toward said discharging wire more than the end portions of said sheet-like member.

5. The charging device according to claim 4, wherein said guiding member includes a rotatable member rotatable correspondingly to opening and closing movement of said sheet-like member.

6. The charging device according to claim 4, wherein said guiding member is provided downstream of the opening with respect to a direction in which said sheet-like member moves when said sheet-like member opens the opening.

7. The charging device according to claim 1, further comprising a winding-up mechanism configured to wind-up said sheet-like member along a longitudinal direction of said sheet-like member, wherein said winding-up mechanism includes an urging member configured to impart an urging force, toward a winding-up direction of said sheet-like member, to said sheet-like member.

8. The charging device according to claim 1, wherein said corona charger is used for electrically charging the photosensitive member substantially uniformly.

9. A charging device comprising:

a corona charger including a discharging wire configured to electrically charge a photosensitive member and a shield forming an opening opposed to said photosensitive member;

a sheet-like member configured to open and close the opening;

a moving mechanism configured to move said sheet-like member substantially along an axial direction of the photosensitive member; and a regulating mechanism configured to regulate a shape of said sheet-like member so as to correspond to a shape of curvature of a peripheral surface of the photosensitive member.

10. A charging device comprising:

a corona charger including a discharging wire configured to electrically charge a photosensitive member and a shield forming an opening opposed to said photosensitive member;

a sheet-like member configured to open and close the opening; and a moving mechanism configured to move said sheet-like member substantially along an axial direction of the photosensitive member, wherein said sheet-like member has been subjected to curling so that a central portion of said sheet-like member protrudes toward said discharging wire more than end portions, in a rotational direction of the photosensitive member, of said sheet-like member.

11. A charging device comprising:

a corona charger including a discharging wire configured to electrically charge a photosensitive member and a shield forming an opening opposed to said photosensitive member;

a sheet-like member configured to open and close the opening; and a moving mechanism configured to move said sheet-like member substantially along an axial direction of the photosensitive member, wherein said sheet-like member has been subjected to curling so that a shape of said sheet-like member corresponds to a shape of curvature of a peripheral surface of the photosensitive member.

12. A charging device comprising:

a corona charger including a discharging wire configured to electrically charge a photosensitive member and a shield forming an opening opposed to the photosensitive member;

a sheet-like member configured to open and close the opening;

a moving mechanism configured to move said sheet-like member substantially along a longitudinal direction of the corona charger; and a regulating mechanism configured to regulate a shape of said sheet-like member so that a central portion of said sheet-like member protrudes toward said discharging wire more than end portions, in a widthwise direction perpendicular to a movement direction of said sheet-like member, of said sheet-like member.

13. The charging device according to claim 12, wherein said regulating mechanism includes a regulating member fixed to said sheet-like member and configured to regulate the shape of said sheet-like member so that the central portion of said sheet-like member protrudes toward said discharging wire more than the end portions of said sheet-like member.

14. The charging device according to claim 13, wherein said regulating member is fixed to a leading end portion of said sheet-like member with respect to a closing movement direction of said sheet-like member.

15. The charging device according to claim 12, wherein said regulating mechanism includes a guiding member configured to guide said sheet-like member so that the central portion of said sheet-like member protrudes more than the end portions of said sheet-like member.

16. The charging device according to claim 15, wherein said guiding member includes a rotatable member rotatable correspondingly to opening and closing movement of said sheet-like member.

17. The charging device according to claim 15, wherein said guiding member is provided downstream of the opening with respect to a direction in which said sheet-like member moves when said sheet-like member opens the opening.

18. The charging device according to claim 12, further comprising a winding-up mechanism configured to wind-up said sheet-like member, when said sheet-like member opens the opening, wherein said winding-up mechanism includes an urging member configured to impart an urging force, toward a winding-up direction of said sheet-like member, to said sheet-like member.

19. The charging device according to claim 12, wherein said corona charger is used for electrically charging the photosensitive member substantially uniformly.

20. A charging device comprising:

a corona charger including a discharging wire configured to electrically charge a photosensitive member and a shield forming an opening opposed to the photosensitive member;

a sheet-like member configured to open and close the opening;

a moving mechanism configured to move said sheet-like member along a longitudinal direction of the opening; and a regulating member fixed to a leading end portion of said sheet-like member with respect to a closing movement direction of said sheet-like member, configured to regulate a shape of the leading end portion of said sheet-like member so that a central portion of said sheet-like member protrudes toward said discharging wire more than end portions, in a rotational direction of the photosensitive member, of said sheet-like member.

21. A charging device comprising:

a corona charger including a discharging wire configured to electrically charge a photosensitive member and a shield forming an opening opposed to the photosensitive member;

a sheet-like member configured to open and close the opening;

a moving mechanism configured to move said sheet-like member along a longitudinal direction of the opening; and a guiding member configured to guide said sheet-like member in contact with said sheet-like member at a surface of said sheet-like member opposing the photosensitive member so that a central portion of said sheet-like member protrudes toward said discharging wire more than end portions, in a rotational direction of the photosensitive member, of said sheet-like member.

22. A charging device comprising:

a corona charger including a discharging wire configured to electrically charge a photosensitive member and a shield forming an opening opposed to the photosensitive member;

a sheet-like member configured to open and close the opening;

a moving mechanism configured to move said sheet-like member along a longitudinal direction of the opening; and a plate-like member fixed to a leading end portion of said sheet-like member with respect to a closing movement direction of said sheet-like member, wherein said plate-like member has a shape such that a central portion of said plate-like member protrudes toward said discharging wire more than end portions, in a rotational direction of the photosensitive member.

23. A charging device for electrically charging a cylindrical photosensitive member, comprising:

a corona charger including a discharging wire configured to electrically charge said photosensitive member and a shield forming an opening opposed to said photosensitive member;

a sheet-like member configured to open and close the opening;

a moving mechanism configured to move said sheet-like member substantially along an axial direction of the photosensitive member; and a regulating mechanism configured to regulate a shape of said sheet-like member so that a central portion of said sheet-like member protrudes toward said discharging wire more than end portions, in a rotational direction of the photosensitive member, of said sheet-like member.

24. A unit comprising:

a cylindrical photosensitive member a corona charger including a discharging wire configured to electrically charge said photosensitive member and a shield forming an opening opposed to said photosensitive member;

a sheet-like member configured to open and close the opening;

a moving mechanism configured to move said sheet-like member substantially along an axial direction of the photosensitive member; and a regulating mechanism configured to regulate a shape of said sheet-like member so that a central portion of said sheet-like member protrudes toward said discharging wire more than end portions, in a rotational direction of the photosensitive member, of said sheet-like member.

25. The unit according to claim 24, wherein said regulating mechanism includes a regulating member fixed to said sheet-like member and configured to regulate the shape of said sheet-like member so that the central portion of said sheet like member protrudes toward said discharging wire more than the end portions of said sheet-like member.

26. The unit according to claim 25, wherein said regulating member is fixed to a leading end portion of said sheet-like member with respect to a closing movement direction of said sheet-like member.

* * * * *